United States Patent [19]

Takada

[11] Patent Number: 4,887,251

[45] Date of Patent: Dec. 12, 1989

[54] WORLD TIMEPIECE

[75] Inventor: Hiroshi Takada, Nara, Japan

[73] Assignee: Sharp Kabushiki Kaisha, Osaka, Japan

[21] Appl. No.: 170,240

[22] Filed: Mar. 18, 1988

[30] Foreign Application Priority Data

Mar. 20, 1987 [JP] Japan ..... 62-40988

[51] Int. Cl.[4] ..... G04B 19/22

[52] U.S. Cl. ..... 368/21

[58] Field of Search ..... 368/21-24, 368/82

[56] References Cited

U.S. PATENT DOCUMENTS 4,245,337 1/1981 Daniels et al. ..... 368/82
4,313,186 1/1982 Yoshida ..... 368/22
4,316,272 2/1982 Naito ..... 368/21
4,669,891 6/1987 Rosevear ..... 368/21
4,681,460 7/1987 Nishimura ..... 368/22

*Primary Examiner*—Vit W. Miska
*Attorney, Agent, or Firm*—Birch, Stewart, Kolasch & Birch

[57] ABSTRACT

A world timepiece which gives information about time or date of areas in different time zones includes an input keyboard for inputting area code information corresponding to an area the time or date of which is required, a code memory for storing the inputted area code information, a counter for counting and storing the time and date of the areas in different time zones, a processor for detecting the operation of a mode selection key, and a display responsive to the processor for displaying the time, the date and the area code in turn of the area corresponding to the area code information of the code memory.

6 Claims, 2 Drawing Sheets

| key operation | display | |
|---|---|---|
| (I) 17 | 17 | input the area code of New York '17.' |
| (II) WORLD | WORLD 6-45 35 PM | display of the time of New York |
| (III) WORLD | WORLD 86-06-30 | display of the date of New York |
| (IV) WORLD<br>while the WORLD key is being pressed | WORLD --- 17.-- | display of the area code of New York |
| (V) | WORLD 6-45 15 PM | again, display of the time of New York |

WORLD TIMEPIECE

BACKGROUND OF THE INVENTION

The present invention relates to a timepiece, and more particularly, to a world timepiece which tells in turn the time, the date, and the area code in turn corresponding to the area code information which was input in advance.

Conventionally, the operability of a conventional world timepiece has been difficult to master, and its whole operation is troublesome to an operator who is not intimately familiary with its operation therefore it can not be obtained easily or quickly.

SUMMARY OF THE INVENTION

Accordingly, it is an object of the present inventon to provide an improved world timepiece the operation of which is simple and from which required information can be obtained easily and quickly.

Briefly described, in accordance with the present invention, a world timepiece comprises a code memory for storing area code information input, means for counting and storing the time and the date of each area, means for detecting and storing the number of times a WORLD key is actuated, and means for telling the time, the date, and the area code of the required area corresponding to the area code information of the code memory according to the number of times the WORLD key is actuated.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figures 1, 3:
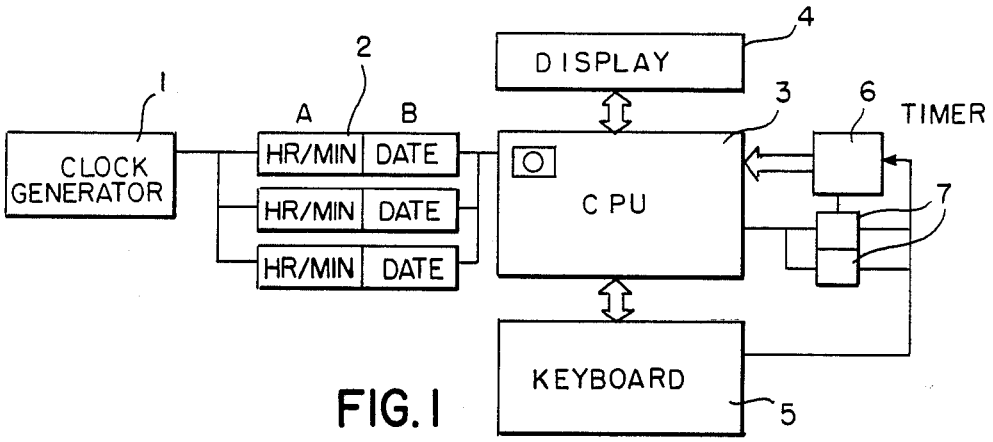
FIG. 1 is a block diagram showing the components of a world timepiece as an embodiment of the present invention.
FIG. 3 is a view showing examples of the operation and display capabilities of the world timepiece of the present invention.

FIG. 1 is a block diagram showing a world timepiece as a preferred embodiment of the present invention. A clock generator 1 supplies a base clock pulse. A counter circuit 2 comprises hour/minute counters (A) and date counters (B). Each of these counters corresponds to a corresponding time zone all over the world.

Processor 3 is a CPU. A liquid crystal display 4 displays information such as time, date, or an area code. A keyboard 5 has a plurality of keys including digit-keys (0–9) and a WORLD key. A timer circuit 6 counts time for a predetermined period (in the present embodiment, preferably for 7 minutes) from whenever the WORLD key is operated. The timer circuit 6 counts time based on the clock pulse generated by the clock generator 1. A flip-flop circuit 7 counts and stores the number of times the WORLD key has been actuated. A code memory a stores the area code which in inputted. The world key is operated as a mode selection key in conjunction with the operation of the area code key.

Figure 2:
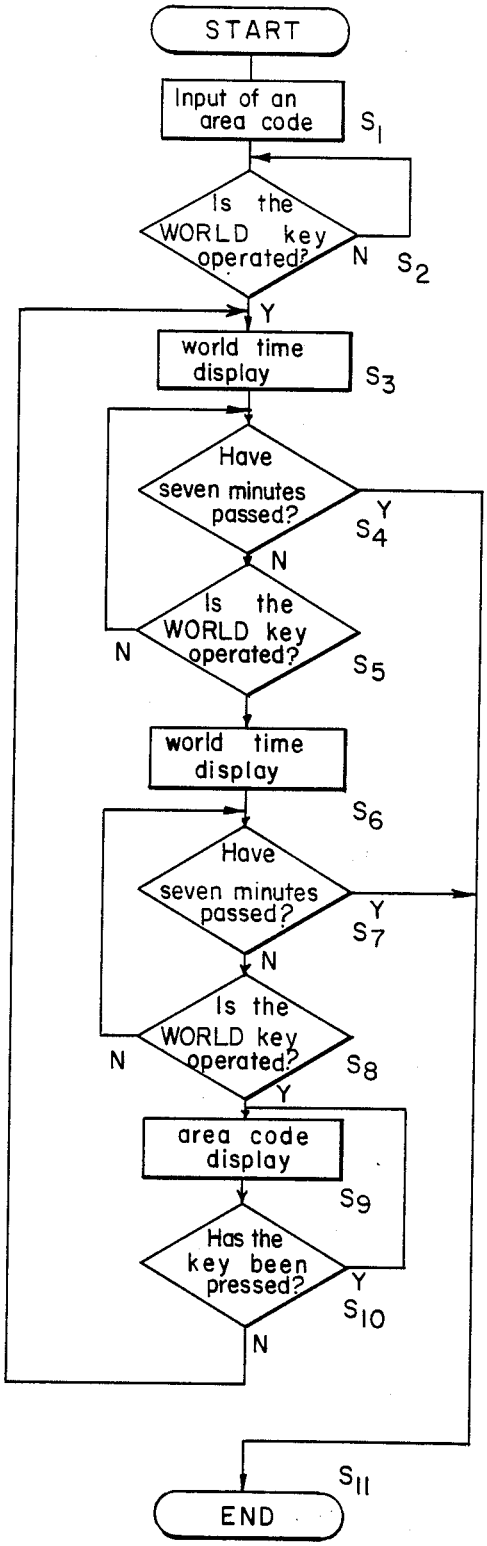
FIG. 2 is a flow chart showing the operation of world timepiece in the embodiment of FIG. 1 of the present invention.

The whole operation of the World Timepiece is explained hereinafter according to FIG. 2 and FIG. 3.

First, and area code of the required area, for example, '17' which represents New York, is inputted through digit-keys of the keyboard 5 (S1). The area code information is then stored at the code memory area a, and is displayed at the display 4 (I) of FIG. 3). At the same time, a counter 2 (the 17th counter) is designated which counts the time and the date of the area corresponding to the associated area code information (New York).

Then, after the WORLD key is actuated (the first operation), the key actuation is detected at step (S2), and the timer circuit 6 starts the counting. Further, one of the flip-flop circuits 7 activates and the number of actuation times '1' of the WORLD key is stored and at the same time, the contents of the date counter A of the 17th time/date counter A, B (New York) chosen according to the area code (17) of the code memory a is displayed at the display 4. Thus, the time at New York is displayed as shown at (II) in FIG. 3.

Then, at step 54, it is determined whether 7 minutes have passed since the most recent actuation of the WORLD key. If 7 minutes have not passed, then at the next step the actuation of the WORLD key is confirmed. Here, if the second actuation of the WORLD key is confirmed (S5), the timer circuit b is reset and starts the counting again. The other of the flip-flop circuits 7 is activated and the number of times '2' of the actuation of the WORLD key is stored. Then, the date counter B which counts the date of New York is chosen according to the area code (17) of the code memory a, and the date information is displayed at the display 4 as is shown at (III) in FIG. 3 (S6).

After the date information of New York is displayed, if the WORLD key is again actuated (S7 and S8), the area code of the code memory a (of New York) is displayed as is shown at (IV) of FIG. 3 (S9 and S10) only while the WORLD key is being pressed. When the WORLD key is released, either of the flip-flop circuits 7 are reset and the time of New York is again displayed as is shown at (V) in FIG. 3.

Thus, after the area code is inputted, only repeated operation of the WORLD key is necessary to display in turn the time, the date, and the area code of the area corresponding to the inputted code.

It is an advantage of the present invention that after the area code is inputted, only repeated actuation of the WORLD key is necessary to display the time, the date, and the area code of the selected area rapidly and without mistake.

While only certain embodiments of the present invention have been described, it will be apparent to those skilled in the art that various changes and modifications may be made therein without departing from the spirit and scope of the present invention as claimed.

I claim:

1. A world timepiece for generating time and date information in each of a plurality of world time zones, comprising:

input means for inputting at least area code information corresponding to one of said plurality of world time zones;

code memory means for storing said input area code information;

means for maintaining a current time and date for each of said plurality of world time zones including means for continuously sequentially counting the time and date information for each of said plurality of world time zones;

means for temporarily storing said current time and date information corresponding to the input area code information for one of said plurality of world time zones; and display means, responsive to said means for accessing, for successively displaying the current time, the current date, and the area code corresponding to the input area code, wherein a first actuation of said means for accessing displays said current time information, a second actuation of said means for accessing displays said current date information, and a third actuation of said means for accessing within a predetermined time period displays the input area code so long as said means for accessing remains actuated, said current time information again being displayed upon release of said means for accessing.

2. The world timepiece according to claim 1, wherein said means for accessing is an identifiable function key provided in connection with said input means.

3. The world timepiece according to claim 1, wherein said display means is a single display area.

4. The world timepiece according to claim 1, further including detection means for detecting an operation mode of said means for accessing.

5. The world timepiece according to claim 4, wherein said detection means is a flip-flop circuit.

6. The world timepiece according to claim 1, wherein said predetermined time is counted by time circuit means for counting the passing time after a most recent actuation of said means for accessing.

* * * * *